US009887519B1

(12) United States Patent
Ito et al.

(10) Patent No.: US 9,887,519 B1
(45) Date of Patent: Feb. 6, 2018

(54) SPARK PLUG

(71) Applicant: NGK SPARK PLUG CO., LTD., Nagoya-shi, Aichi (JP)

(72) Inventors: Kazuki Ito, Kasugai (JP); Daisuke Sumoyama, Nagoya (JP); Tsutomu Shibata, Owariashi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/623,817

(22) Filed: Jun. 15, 2017

(30) Foreign Application Priority Data

Jul. 15, 2016 (JP) ..... 2016-139947

(51) Int. Cl.
*H01T 13/39* (2006.01)
*H01T 13/16* (2006.01)

(52) U.S. Cl.
CPC ..... *H01T 13/39* (2013.01); *H01T 13/16* (2013.01)

(58) Field of Classification Search
CPC ..... H01T 13/39; H01T 13/20; H01T 13/16
See application file for complete search history.

(56) References Cited

U.S. PATENT DOCUMENTS

2004/0013560 A1* 1/2004 Hrastnik ..... C22C 19/03 420/455
2004/0036395 A1* 2/2004 Makino ..... H01T 13/39 313/141
2007/0290591 A1* 12/2007 Lykowski ..... H01T 13/39 313/141
2015/0340844 A1 11/2015 Yoshimoto et al. .... H01T 13/39

FOREIGN PATENT DOCUMENTS

EP 2930802 A1 10/2015
JP 5662622 B2 12/2014 ..... H01T 13/39
WO WO-2007/149826 A2 12/2007
WO WO 2010029944 A1 * 3/2010 ..... B23K 35/322
WO WO 2011152004 A1 * 12/2011 ..... C22C 19/05

OTHER PUBLICATIONS

Extended European Search Report issued in corresponding European Patent Application No. 17179536.2 dated Dec. 1, 2017.

* cited by examiner

*Primary Examiner* — Mariceli Santiago
(74) *Attorney, Agent, or Firm* — Kusner & Jaffe

(57) ABSTRACT

A spark plug having a center electrode and a ground electrode that form a gap therebetween. At least one of the center electrode and the ground electrode includes a portion formed of a nickel alloy containing nickel as a major component and 20% by mass or more of chromium. In the portion, formed of the nickel alloy, of the electrode, the content of silicon is 0.1% by mass or more, the total content of one or more particular elements selected from the group consisting of rare earth elements is 0.01% by mass or more, and the area percentage of voids in the total area of a cross-section parallel to a longitudinal direction is 1% or less.

5 Claims, 3 Drawing Sheets

SPARK PLUG

RELATED APPLICATIONS

This application claims the benefit of Japanese Patent Application No. 2016-139947, filed Jul. 15, 2016, the entire contents of which are incorporated herein by reference.

FIELD OF THE INVENTION

This specification relates to spark plugs for ignition of fuel gases in equipment such as internal-combustion engines.

BACKGROUND OF THE INVENTION

Spark plugs for use in internal-combustion engines include, for example, an insulator having an axial hole extending in the axial direction, a center electrode inserted in the axial hole, a cylindrical metal shell disposed around the insulator, and a ground electrode connected to the metal shell. There are also known spark plugs that include noble metal tips disposed on the center electrode and the ground electrode at positions where they form a gap where spark discharge occurs to achieve improved wear resistance.

Center electrodes and ground electrodes require high oxidation resistance since they are exposed to high-temperature combustion gases in internal-combustion engines. For example, an alloy that has been proposed for use as a material for a ground electrode contains nickel (Ni) as a major component, 0.50% to less than 1.0% by mass of silicon (Si), 0.2% to 2.0% by mass of aluminum (Al), 12% to 34% by mass of chromium (Cr), 0.03% to 0.2% by mass of at least one element selected from the group consisting of rare earth elements, more than 0% to 20% by mass of iron (Fe), 0.10% by mass or less of carbon (C), and 1.0% by mass or less of manganese (Mn). The total content of silicon (Si) and aluminum (Al) is 0.80% by mass or more and is 1/10 or less of the content of Cr. It is believed that the use of such a composition improves the oxidation resistance of the electrode and thus, for example, inhibits the formation of oxide scale between the electrode and the tip, thereby improving the anti-peeling performance of the tip.

Unfortunately, the related art discussed above is not sufficiently designed to improve the heat conduction performance of the material and can thus lead to, for example, pre-ignition due to electrode overheating.

This specification discloses a technology for reducing the likelihood of pre-ignition induced by spark plugs for use in internal-combustion engines while ensuring sufficient oxidation resistance of electrodes.

The technology disclosed in this specification can be implemented as the following application examples.

SUMMARY OF THE INVENTION

Application Example 1

In accordance with a first aspect of the present invention, there is provided a spark plug having a center electrode and a ground electrode that form a gap therebetween. At least one of the center electrode and the ground electrode includes a portion formed of a nickel alloy containing nickel as a major component and 20% by mass or more of chromium. In the portion, formed of the nickel alloy, of the electrode, the content of silicon is 0.1% by mass or more, the total content of one or more particular elements selected from the group consisting of rare earth elements is 0.01% by mass or more, and the area percentage of voids in the total area of a cross-section parallel to a longitudinal direction is 1% or less.

According to this example, in the portion, formed of the nickel alloy, of the electrode, the content of chromium is 20% by mass or more, the content of silicon is 0.1% by mass or more, and the total content of one or more particular elements selected from the group consisting of rare earth elements is 0.01% by mass or more. As a result, a dense, peel-resistant oxide film forms on the surface, thus improving the oxidation resistance. In addition, the area percentage of voids in the nickel alloy in the total area of a cross-section parallel to the longitudinal direction is 1% or less. As a result, the decrease in thermal conductivity due to the presence of voids can be reduced, thus improving the heat conduction performance of the electrode and thereby reducing the likelihood of pre-ignition. The likelihood of pre-ignition can thus be reduced while sufficient oxidation resistance of the electrode is ensured.

Application Example 2

In accordance with a second aspect of the present invention, there is provided a spark plug as described above, wherein, in the portion formed of the nickel alloy of the electrode of the spark plug, the content of iron is 11% to 19% by mass, the content of chromium is 30% by mass or less, the content of silicon is 1% by mass or less, the total content of the one or more particular elements is 0.2% by mass or less, and the product of the content of silicon and the content of the one or more particular elements is 0.15 or less.

According to this example, the heat conduction performance of the electrode can be further improved. Since the heat conduction performance of the electrode can be further improved, the likelihood of pre-ignition can be further reduced while sufficient oxidation resistance of the electrode is ensured.

Application Example 3

In accordance with a third aspect of the present invention, there is provided a spark plug as described above, wherein, in the portion formed of the nickel alloy of the electrode of the spark plug, the content of carbon is 0.1% by mass or less, and the content of aluminum is 0.2% to 1.5% by mass.

According to this example, the heat conduction performance of the electrode can be further improved. The likelihood of pre-ignition can thus be further reduced while sufficient oxidation resistance of the electrode is ensured.

Application Example 4

In accordance with a fourth aspect of the present invention, there is provided a spark plug as described above, wherein, in the portion formed of the nickel alloy of the electrode of the spark plug, the content of aluminum is 0.5% to 1.0% by mass, the content of chromium is 26% by mass or less, and the content of iron is 13% to 17% by mass.

According to this example, the heat conduction performance of the electrode can be further improved. The likelihood of pre-ignition can thus be further reduced while sufficient oxidation resistance of the electrode is ensured.

Application Example 5

In accordance with a fifth aspect of the present invention, there is provided a spark plug as described above, wherein, in the portion formed of the nickel alloy of the electrode of the spark plug, the area percentage of voids in the total area of the cross-section parallel to the longitudinal direction is 0.5% or less.

According to this example, the decrease in thermal conductivity due to the presence of voids can be further reduced, thus further improving the heat conduction performance of the electrode. The likelihood of pre-ignition can thus be further reduced while sufficient oxidation resistance of the electrode is ensured.

The present invention can be implemented in various embodiments. Example embodiments include spark plugs, ignition systems including such spark plugs, internal-combustion engines including such spark plugs, internal-combustion engines including ignition systems including such spark plugs, spark plug electrodes, and alloys for spark plug electrodes.

DETAILED DESCRIPTION OF THE PREFERRED EMBODIMENTS

A. Embodiment

A-1. Configuration of Spark Plug

Figure 1:
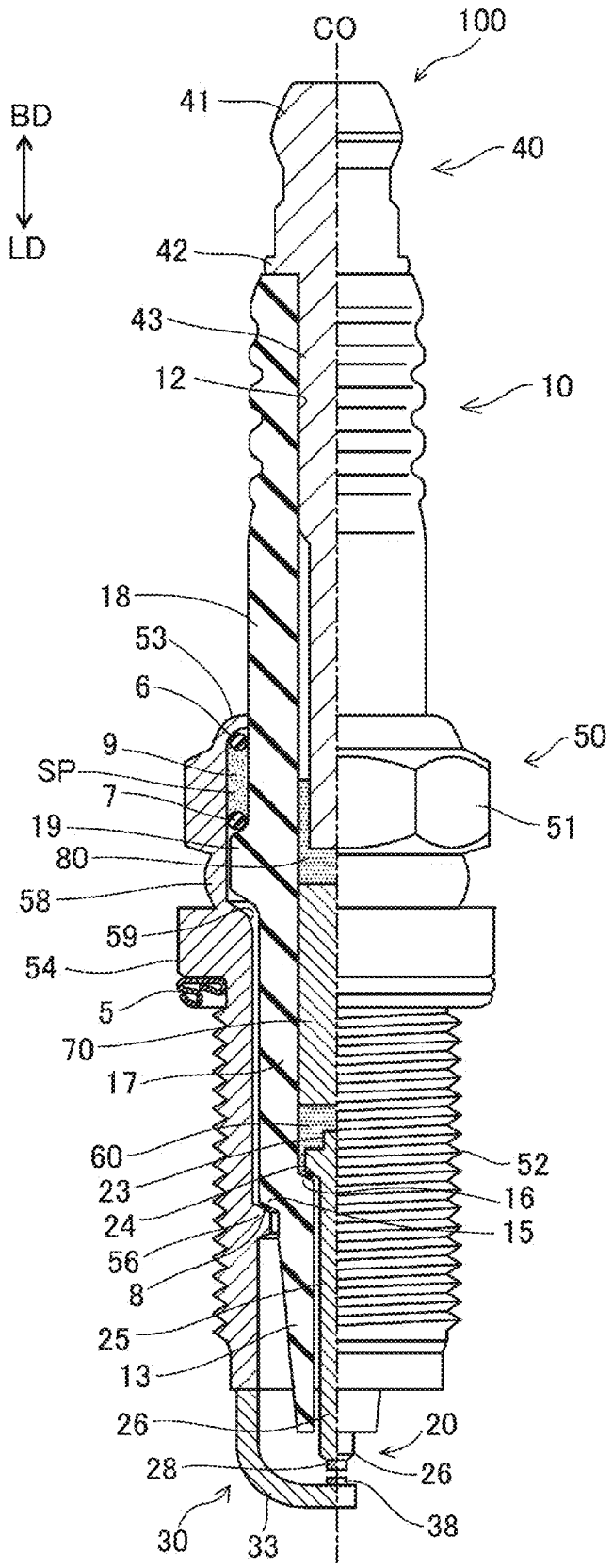
FIG. 1 is a sectional view of an example spark plug 100 according to an embodiment.

FIG. 1 is a sectional view of an example spark plug according to an embodiment. The dot-and-dash line shown in FIG. 1 indicates the axial line CO of a spark plug 100. The cross-section shown in FIG. 1 is a cross-section including the axial line CO. A direction parallel to the axial line CO is hereinafter referred to as "axial direction". Of the opposite directions parallel to the axial line CO, the downward direction in FIG. 1 is referred to as "leading direction LD", whereas the upward direction in FIG. 1 is referred to as "backward direction BD". The leading direction LD is the direction from a terminal nut 40 toward electrodes 20 and 30, described later. The radial direction of a circle that is centered on the axial line CO and that is located in a plane perpendicular to the axial line CO is simply referred to as "radial direction", and the circumferential direction of the circle is simply referred to as "circumferential direction". The end pointing in the leading direction LD is simply referred to as "leading end", whereas the end pointing in the backward direction BD is simply referred to as "back end".

The spark plug 100 includes an insulator 10, a center electrode 20, a ground electrode 30, a terminal nut 40, a metal shell 50, a first conductive seal layer 60, a resistor 70, a second conductive seal layer 80, a first packing 8, talc 9, a second packing 6, and a third packing 7.

The insulator 10 is a substantially cylindrical member having an axial hole 12 extending through the insulator 10 in the axial direction. The insulator 10 is formed of sintered alumina (other insulating materials may also be used). The insulator 10 includes, in order from the side facing the leading end in the backward direction BD, a nose section 13, a reduced-outer-diameter section 15, a first barrel section 17, a flange section 19, and a second barrel section 18. The outer diameter of the reduced-outer-diameter section 15 decreases gradually in the leading direction LD. The insulator 10 also includes a reduced-inner-diameter section 16 near the reduced-outer-diameter section 15 (in the example in FIG. 1, inside the first barrel section 17). The inner diameter of the reduced-inner-diameter section 16 decreases gradually in the leading direction LD.

The center electrode 20 is located in the axial hole 12 near the leading end of the insulator 10. The center electrode 20 includes a center electrode tip 28 and a center electrode body 26.

The center electrode body 26 is a rod-shaped member extending in the axial direction. The center electrode body 26 includes, in order from the side facing the leading end in the backward direction BD, a nose section 25, a flange section 24, and a head section 23. The portion of the nose section 25 near the leading end is located outside the axial hole 12 at the leading end of the insulator 10. The other portion of the center electrode 20 is held in the axial hole 12. The surface of the flange section 24 facing the leading end is supported by the reduced-inner-diameter section 16 of the insulator 10.

The center electrode body 26 is formed of, for example, nickel (Ni) or an alloy containing nickel as a major component (e.g., NCF600 or NCF601). The center electrode body 26 may include an embedded core formed of copper or an alloy containing copper as a major component, which has a higher thermal conductivity than Ni or an alloy containing Ni as a major component.

The center electrode tip 28 is bonded to the leading end of the nose section 25 of the center electrode body 26, for example, by laser welding. The center electrode tip 28 is formed of a material containing a high-melting-point noble metal as a major component. For example, the center electrode tip 28 is formed of iridium (Ir), platinum (Pt), or an alloy containing Ir or Pt as a major component.

The terminal nut 40 is located in the axial hole 12 near the back end of the insulator 10. The terminal nut 40 is a rod-shaped member extending in the axial direction and is formed of a conductive material (e.g., a metal such as low-carbon steel). The terminal nut 40 includes, in order from the side facing the leading end in the backward direction BD, a nose section 43, a flange section 42, and a cap mounting section 41. The nose section 43 is inserted in the axial hole 12 of the insulator 10. The cap mounting section 41 is located outside the axial hole 12 at the back end of the insulator 10.

The cylindrical resistor 70 is disposed in the axial hole 12 of the insulator 10 between the terminal nut 40 and the center electrode 20. The resistor 70 functions to reduce radio interference noise during sparking. The resistor 70 is formed of, for example, a composition containing glass particles as a major component, ceramic particles other than glass particles, and a conductive material.

The first conductive seal layer 60 is disposed between the center electrode 20 and the resistor 70. The second conductive seal layer 80 is disposed between the terminal nut 40 and the resistor 70. As a result, the center electrode 20 and the terminal nut 40 are electrically connected together via the resistor 70 and the conductive seal layers 60 and 80. The conductive seal layers 60 and 80 are formed of, for example, a composition containing glass particles such as $B_2O_3$—$SiO_2$-based glass particles and metal particles (e.g., Cu or Fe).

The metal shell 50 is a substantially cylindrical member having an insertion hole 59 extending through the metal shell 50 along the axial line CO. The metal shell 50 is formed of low-carbon steel (other conductive materials, including metals, may also be used). The insulator 10 is inserted in the insertion hole 59 of the metal shell 50. The metal shell 50 is disposed radially around the insulator 10 to hold the insulator 10. The leading end of the insulator 10 (in this embodiment, the portion of the nose section 13 near the leading end) is located outside the insertion hole 59 at the leading end of the metal shell 50. The back end of the insulator 10 (in this embodiment, the portion of the second barrel section 18 facing near back end) is located outside the insertion hole 59 at the back end of the metal shell 50.

The metal shell 50 includes, in order from the side facing the leading end in the backward direction BD, a threaded section 52, a seat section 54, a deformed section 58, a tool engagement section 51, and a crimped section 53. An annular gasket 5 is fitted between the seat section 54 and the threaded section 52. The annular gasket 5 is formed by bending a metal sheet.

The seat section 54 is a flanged section. The threaded section 52 is a substantially cylindrical section having a threaded outer surface for threading into an installation hole of an internal-combustion engine.

The metal shell 50 includes a reduced-inner-diameter section 56 located closer to the leading end than the deformed section 58. The inner diameter of the reduced-inner-diameter section 56 decreases gradually from the side facing the back end in the leading direction LD. The first packing 8 is held between the reduced-inner-diameter section 56 of the metal shell 50 and the reduced-outer-diameter section 15 of the insulator 10. The first packing 8 is an iron O-ring (other materials, including metals such as copper, may also be used).

The tool engagement section 51 is shaped to engage with a spark plug wrench (e.g., a hexagonal prism). The crimped section 53 is provided at the back end of the tool engagement section 51. The crimped section 53 is located closer to the back end than the flange section 19 of the insulator 10, forming the back end of the metal shell 50. The crimped section 53 is formed by bending the metal shell 50 radially inward.

An annular space SP is formed between the inner surface of the metal shell 50 and the outer surface of the insulator 10 near the back end of the metal shell 50. In this embodiment, the space SP is defined by the crimped section 53 and the tool engagement section 51 of the metal shell 50 and the back end of the flange section 19 and the second barrel section 18 of the insulator 10. The second packing 6 is disposed at the back end of the space SP. The third packing 7 is disposed at the leading end of the space SP. In this embodiment, the packings 6 and 7 are iron C-rings (other materials may also be used). The space SP between the two packings 6 and 7 is filled with powdered talc 9.

In the manufacture of the spark plug 100, the crimped section 53 is formed by bending the metal shell 50 inward. The crimped section 53 is then pressed toward the leading end. Accordingly, the deformed section 58 is formed, and the insulator 10 is pressed toward the leading end via the packings 6 and 7 and the talc 9 in the metal shell 50. The first packing 8 is pressed between the reduced-outer-diameter section 15 and the reduced-inner-diameter section 56 to form a seal between the metal shell 50 and the insulator 10. This prevents gas from leaking out of the combustion chamber of an internal-combustion through a gap between the metal shell 50 and the insulator 10. The metal shell 50 is fixed to the insulator 10.

The ground electrode 30 includes a ground electrode body 33 and a ground electrode tip 38. The ground electrode body 33 is a rod-shaped member electrically connected to the metal shell 50. The ground electrode body 33 is formed of, for example, an alloy containing nickel (Ni) as a major component. The nickel alloy used to form the ground electrode body 33 will be described in detail later.

As with the center electrode body 26, the ground electrode body 33 may include an embedded core formed of copper or an alloy containing copper as a major component, which has a higher thermal conductivity than Ni or an alloy containing Ni as a major component. The ground electrode tip 38 is formed of, for example, Ir, Pt, or an alloy containing Ir or Pt as a major component.

A-2. Configuration of Spark Plug Near Leading End

Figure 2:
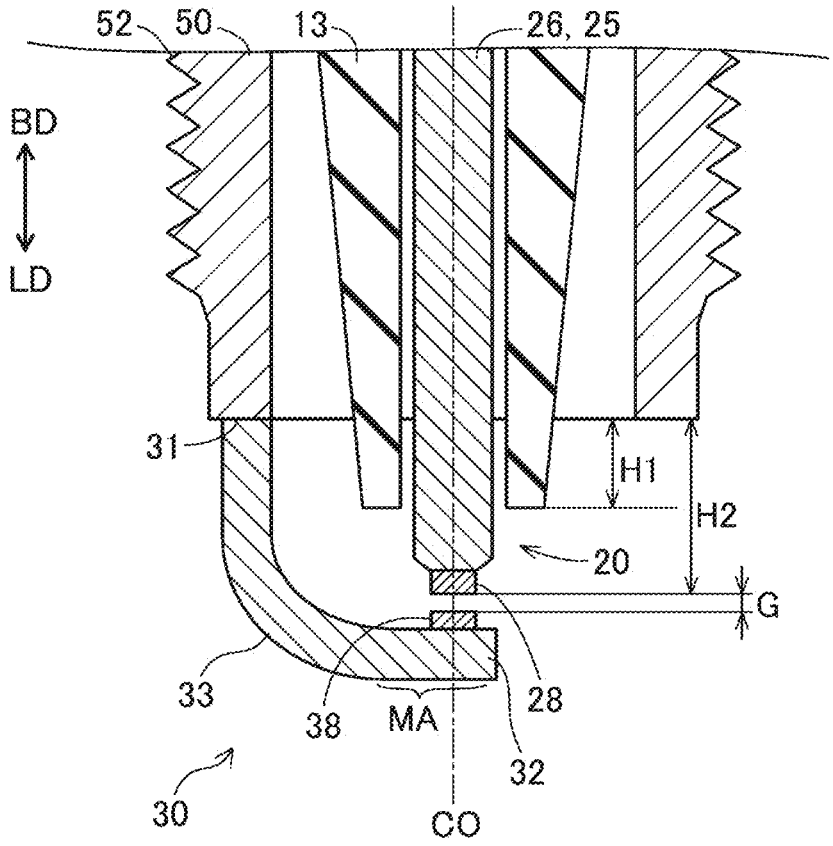
FIG. 2 is an enlarged sectional view of the spark plug 100 near the leading end thereof.

The configuration of the spark plug 100 near the leading end thereof will now be described in detail with reference to FIG. 2. FIG. 2 is an enlarged sectional view of the spark plug 100 near the leading end thereof.

The leading end of the insulator 10 (i.e., the leading end of the nose section 13) is located forward of the leading end of the metal shell 50. The leading end of the center electrode body 26 and the center electrode tip 28 are located forward of the leading end of the insulator 10.

One end of the ground electrode body 33 is a connected end 31 connected to the leading end of the metal shell 50, for example, by resistance welding, so that the ground electrode 30 and the metal shell 50 are electrically connected together. The other end of the ground electrode body 33 is a free end 32. The ground electrode body 33 extends from the connected end 31 connected to the metal shell 50 in the leading direction LD, bends toward the axial line CO, and extends to the free end 32 in a direction perpendicular to the axial line CO.

One side surface of the portion of the ground electrode body 33 near the free end 32 extending in the direction perpendicular to the axial line CO faces the center electrode tip 28 along the axial line CO in the axial direction. The ground electrode tip 38 is welded to the side surface of the ground electrode body 33 at a position opposite the center electrode tip 28. The ground electrode tip 38 and the center electrode tip 28 form a gap where spark discharge occurs therebetween.

The cross-section of the ground electrode body 33 in FIG. 2 is a cross-section of the ground electrode body 33 taken in a plane passing through the axial line of the rod-shaped ground electrode body 33. The cross-section of the ground electrode body 33 in FIG. 2 is a cross-section parallel to the longitudinal direction of the ground electrode body 33.

The cross-section of the center electrode body 26 in FIG. 2 is a cross-section of the center electrode body 26 taken in a plane passing through the axial line of the rod-shaped center electrode body 26. The cross-section of the center electrode body 26 in FIG. 2 is a cross-section parallel to the longitudinal direction of the center electrode body 26.

A-3. Material Used to Form Ground Electrode Body 33

The material used to form the ground electrode body 33 will now be described. The ground electrode body of a ground electrode is placed at the innermost position in a combustion chamber; therefore, it is exposed to high-temperature combustion gases. Accordingly, the ground electrode body requires high oxidation resistance. In particular, there is a need for a material with a higher oxidation resistance for the ground electrode body since the temperatures inside the combustion chambers of internal-combustion engines are becoming higher for reduced emissions and improved fuel economy and spark plugs are also becoming smaller. On the other hand, the addition of other elements as additives to a Ni alloy used to form the ground electrode body to improve the oxidation resistance generally decreases the thermal conductivity and thus decreases the heat conduction performance of the ground electrode body. This causes a problem in that the ground electrode body tends to overheat and induce pre-ignition. In this embodiment, the material used to form the ground electrode body 33 is designed to improve the heat conduction performance and thereby reduce the likelihood of pre-ignition while ensuring sufficient oxidation resistance of the ground electrode body 33. A detailed description is given below.

The material for the ground electrode body 33 is an alloy containing Ni as a major component. As used herein, the term "alloy containing nickel as a major component" (hereinafter simply referred to as "Ni alloy") refers to an alloy in which Ni is present in the largest amount (in % by mass) of the components (elements) present in the alloy. An alloy containing nickel as a major component has a higher oxidation resistance than, for example, an alloy containing iron (Fe) as a major component. For example, the use of an alloy containing Fe as a major component results in insufficient oxidation resistance, even if the contents of the additives described later are controlled, since the base alloy has insufficient oxidation resistance.

The Ni alloy contains, as additives, at least chromium (Cr), silicon (Si), and one or more particular elements selected from the group consisting of rare earth elements. The group consisting of rare earth elements includes yttrium (Y), scandium (Sc), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Examples of rare earth elements suitable for practical use include Y, La, Ce, and Nd.

In the ground electrode body 33 formed of the Ni alloy, (1) the content of Cr is 20% by mass or more;

(2) the content of Si is 0.1% by mass or more; and (3) the total content of one or more rare earth elements is 0.01% by mass or more.

As a result, sufficient sufficient oxidation resistance the Ni alloy is ensured.

Cr forms a chromium oxide ($Cr_2O_3$) film on the surface of the Ni alloy. Satisfying condition (1) above allows a $Cr_2O_3$ film to form on the surface of the alloy in an amount sufficient to improve the oxidation resistance of the alloy.

Si, when added in small amounts, forms a denser oxide (e.g., silica) film below the $Cr_2O_3$ film on the surface of the alloy since silicon oxide has a lower standard free energy of formation ($\Delta G°$) than chromium oxide. Satisfying condition (2) above allows a silicon oxide film to form below the $Cr_2O_3$ film in an amount sufficient to improve the oxidation resistance of the Ni alloy.

Rare earth elements tend to accumulate in the interface between the Ni alloy and the oxide film ($Cr_2O_3$ and silica) formed on the surface of the Ni alloy and, when added in small amounts, function to strengthen the bond between the Ni alloy and the oxide film in the interface therebetween. Satisfying condition (3) above strengthens the bond between the alloy and the oxide film and thus reduces the peeling of the oxide film, thereby improving the oxidation resistance of the Ni alloy.

In the ground electrode body 33 formed of the Ni alloy, (4) the area percentage of voids (small empty spaces in the material) in the total area of a cross-section (e.g., the cross-section of the ground electrode body 33 in FIG. 2) parallel to the longitudinal direction (hereinafter referred to as "void area percentage") is 1% or less.

As a result, the heat conduction performance of the ground electrode body 33 can be improved, thus reducing the likelihood of pre-ignition.

A higher void area percentage results in a decrease in the macroscopic thermal conductivity of the Ni alloy since the voids in the Ni alloy have a lower thermal conductivity than the remaining portion. Satisfying condition (4) above reduces the decrease in the thermal conductivity of the ground electrode body 33 due to the presence of the inner voids. As a result, the heat conduction performance of the ground electrode body 33 can be improved, thus reducing the likelihood of pre-ignition.

As is evident from the foregoing description, satisfying conditions (1) to (4) above in this embodiment reduces the likelihood of pre-ignition while ensuring sufficient oxidation resistance of the ground electrode 30 (ground electrode body 33).

Preferably, in addition to conditions (1) to (4) above, the ground electrode body 33 formed of the Ni alloy satisfies conditions (5) to (9):

(5) the content of Fe is 11% to 19% by mass;

(6) the content of Cr is 30% by mass or less;

(7) the content of Si is 1% by mass or less;

(8) the total content of one or more rare earth elements is 0.2% by mass or less; and (9) the product of the content (in % by mass) of Si and the total content (in % by mass) of one or more rare earth elements is 0.15 or less.

Figure 3:
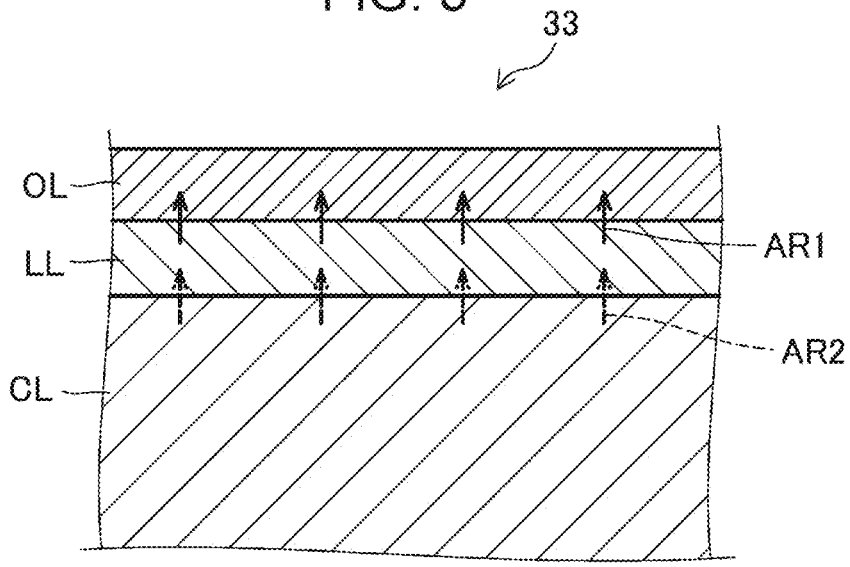
FIG. 3 is a schematic view of the structure of a ground electrode body 33 near the surface thereof at high temperature.

FIG. 3 is a schematic view of the structure of the ground electrode body 33 (Ni alloy) near the surface thereof at high temperature. As indicated by arrows AR1 in FIG. 3, an oxide film OL (e.g., $Cr_2O_3$ and silica films), described above, forms on the surface of the Ni alloy at a high temperature at which the spark plug 100 is used (e.g., 900° C.). The oxide film OL is mainly composed of a $Cr_2O_3$ film. As the oxide film OL forms, Cr present in the Ni alloy near the surface thereof migrates toward the surface. As a result, a Cr-deficient layer LL having a lower Cr content than the core CL of the Ni alloy forms below the oxide film OL near the surface of the Ni alloy. In practice, no clear boundary appears between the Cr-deficient layer LL and the core CL since the Cr content changes gradually from the surface toward the center of the alloy. In FIG. 3, the Cr-deficient layer LL and the core CL are shown as being clearly defined for simplicity of illustration.

A metal having a lower additive content (concentration) has a higher thermal conductivity. Hence, the Cr-deficient layer LL, which has a lower Cr content than the core CL, has a higher thermal conductivity than the core CL. The presence of the Cr-deficient layer LL thus improves the heat conduction performance of the ground electrode body 33. As the Cr-deficient layer LL forms, a concentration gradient of Cr appears between the Cr-deficient layer LL and the core CL. As indicated by arrows AR2 in FIG. 3, Cr migrates from the core CL into the Cr-deficient layer LL as a result of concentration diffusion. As the migration of Cr is promoted by diffusion, the deficiency of Cr in the Cr-deficient layer LL is eliminated, and the Cr-deficient layer LL, which improves the heat conduction performance, diminishes or disappears.

A higher content of Fe results in a lower diffusion rate of Cr since Fe impedes the migration of Cr due to diffusion. If the content of Fe is 11% by mass or more, the resulting Cr-deficient layer LL is maintained, thus improving the heat conduction performance of the ground electrode body 33. However, if the content of Fe is excessively high, intercrystalline cracking occurs in the Ni alloy during continuous use in a high-temperature environment. The heat conduction performance of the ground electrode body 33 may decrease as more defects are created in the Ni alloy by intercrystalline cracking. This is because the defects in the alloy decrease the thermal conductivity of the alloy. If the content of Fe is 19% by mass or less, intercrystalline cracking is inhibited in the Ni alloy, thus reducing the decrease in the heat conduction performance of the ground electrode body 33. Therefore, satisfying condition (5) above inhibits intercrystalline cracking in the Ni alloy during continuous use in a high-temperature environment while maintaining the Cr-deficient layer LL, thus further improving the heat conduction performance of the ground electrode body 33.

If the content of Cr is excessively high, the Cr-deficient layer LL may have an insufficiently low content of Cr and may also require a considerable period of time to form. Satisfying condition (6) above allows the Cr-deficient layer LL to have a sufficiently low content of Cr and to form within a short period of time. The heat conduction performance of the ground electrode body 33 can thus be further improved.

The oxide film OL has a lower thermal conductivity than the Cr-deficient layer LL and the core CL; therefore, an excessively thick oxide film OL may decrease the heat conduction performance of the ground electrode body 33. If the content of Si is excessively high, the oxide film OL may become excessively dense. Such an oxide film OL may resist peeling and thus become excessively thick. If the content of rare earth elements is excessively high, the bond between the oxide film OL and the surface of the alloy may become excessively strong. Such an oxide film OL may resist peeling and thus become excessively thick. Satisfying conditions (7) to (9) above inhibits the oxide film OL from becoming excessively thick due to the presence of Si and rare earth elements. The heat conduction performance of the ground electrode body 33 can thus be further improved.

As is evident from the foregoing description, satisfying conditions (5) to (9) above further improves the heat conduction performance of the ground electrode 30. The likelihood of pre-ignition can thus be more effectively reduced while sufficient oxidation resistance of the ground electrode 30 is ensured.

More preferably, in addition to conditions (1) to (9) above, the ground electrode body 33 formed of the Ni alloy satisfies conditions (10) and (11):

(10) the content of carbon (C) is 0.1% by mass or less; and

(11) the content of aluminum (Al) is 0.2% to 1.5% by mass.

C reacts with Cr in the Ni alloy to form chromium carbide (e.g., $Cr_3C_2$), which has low thermal conductivity. Satisfying condition (10) reduces the formation of chromium carbide and thus further improves the heat conduction performance of the ground electrode body 33.

Al forms a layer of aluminum nitride (AlN) between the oxide film OL and the Ni alloy. AlN has a higher thermal conductivity than the Ni alloy. If the content of Al is 0.2% by mass or more, a layer of aluminum nitride (AlN) forms, thus further improving the heat conduction performance of the ground electrode body 33. However, if the content of Al is excessively high, intercrystalline cracking occurs in the Ni alloy during continuous use in a high-temperature environment. As described above, the heat conduction performance of the ground electrode body 33 may decrease as a result of decreased thermal conductivity as more defects are created in the Ni alloy by intercrystalline cracking. If the content of Al is 1.5% by mass or less, intercrystalline cracking is inhibited in the Ni alloy, thus reducing the decrease in the heat conduction performance of the ground electrode body 33. Therefore, satisfying condition (11) above allows an AlN layer to form while inhibiting intercrystalline cracking, thus further improving the heat conduction performance of the ground electrode body 33.

As is evident from the foregoing description, satisfying conditions (10) and (11) above further improves the heat conduction performance of the ground electrode body 33 without decreasing the oxidation resistance of the ground electrode body 33. The likelihood of pre-ignition can thus be more effectively reduced while sufficient oxidation resistance of the ground electrode 30 is ensured.

Even more preferably, in addition to conditions (1) to (11) above, the ground electrode body 33 formed of the Ni alloy satisfies conditions (12) to (14):

(12) the content of Al is 0.5% to 1.0% by mass;

(13) the content of Cr is 26% by mass or less; and

(14) the content of Fe is 13% to 17% by mass.

As a result, the heat conduction performance of the ground electrode body 33 can be further improved. Since the heat conduction performance of the ground electrode 30 can be further improved, the likelihood of pre-ignition can be further reduced while sufficient oxidation resistance of the ground electrode 30 is ensured.

Limiting the content of Al to a narrower range, as indicated by condition (12) above, allows the formation of a larger amount of AlN layer, which has high thermal conductivity, while inhibiting finer intercrystalline cracking. Lowering the upper limit of the content of Cr, as indicated by condition (13) above, allows the Cr-deficient layer LL to have a lower content of Cr and to form within a shorter period of time.

As a result, satisfying conditions (12) to (14) above further improves the heat conduction performance of the ground electrode body 33. The likelihood of pre-ignition can thus be more effectively reduced while sufficient oxidation resistance of the ground electrode 30 is ensured.

Most preferably, in addition to conditions (1) to (14) above, the ground electrode body 33 formed of the Ni alloy satisfies condition (15):

(15) the void area percentage is 0.5% or less.

As a result, the decrease in the thermal conductivity of the ground electrode body 33 due to the presence of voids can be further reduced, thus further improving the heat conduction performance of the ground electrode body 33. The likelihood of pre-ignition can thus be most effectively reduced while sufficient oxidation resistance of the ground electrode 30 is ensured.

A-3. Method for Manufacturing Ground Electrode Body 33

The ground electrode body 33 is manufactured through melting, cooling, and processing steps. In the melting step, a melt of an alloy having the desired constituent composition is prepared in a common vacuum melting furnace. In the cooling step, the melt is allowed to cool in the vacuum melting furnace to obtain an ingot. In the processing step, the ingot is hot-forged to obtain a rod with a predetermined diameter (e.g., 1.6 mm). In the processing step, the rod is cold-drawn to obtain a wire having a predetermined cross-sectional size (e.g., a 1.3 mm×2.7 mm rectangle). The wire is cut to a predetermined length (e.g., 15 mm) to obtain the ground electrode body 33.

One end of the resulting ground electrode body 33 is bonded to the leading end of the metal shell 50, and the ground electrode tip 38 is welded near the other end of the ground electrode body 33, followed by bending. The ground electrode 30 is thus finished.

Figure 4:
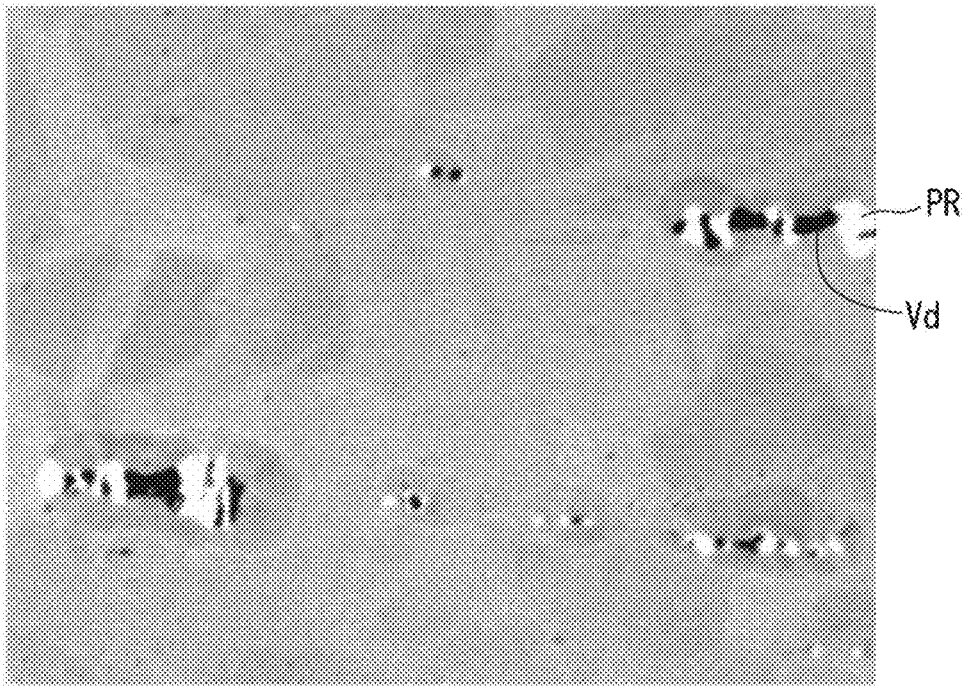
FIG. 4 is a compositional image of a cross-section of the ground electrode body 33 taken in a plane parallel to the longitudinal direction.

A method for reducing the void area percentage will now be described. FIG. 4 is a compositional image of a cross-section of the ground electrode body 33 taken in a plane parallel to the longitudinal direction. The compositional image is a backscattered-electron compositional image captured under a scanning electron microscope (SEM). The white regions in FIG. 4 are precipitates containing Si and a rare earth element as major components. The black regions present adjacent to the precipitates in FIG. 4 are voids. As shown, voids appear near precipitates.

Few voids are found in the alloy before drawing in the processing step, demonstrating that voids are introduced into the alloy during drawing. Voids are probably created during drawing by a stress that occurs between the precipitates and the matrix (the gray region in FIG. 4) because of the difference in processability (e.g., ductility and hardness) between the matrix and the precipitates.

Accordingly, there are two approaches to reduce voids: reducing the amount of precipitate and reducing the stress that occurs between the precipitates and the matrix. The amount of precipitate can be reduced by reducing the amount of melt produced at one time and thereby increasing the cooling rate of the melt in the cooling step. This approach allowed for a void area percentage of 1% or less.

Furthermore, the replacement of cold drawing with hot drawing (e.g., at 1,000° C.) allowed for a void area percentage of 0.5% or less. This is probably because hot drawing alleviated the stress that occurred between the precipitates and the matrix during drawing.

B. Evaluation Tests

Evaluation tests were carried out to evaluate sample spark plugs for oxidation resistance and resistance to pre-ignition (hereinafter referred to as "pre-ignition resistance"). In these evaluation tests, 53 types of samples, referred to as Samples 1 to 53, were prepared, as shown in Tables 1 and 2 below. These samples were identical to the spark plug 100 described above except for the material (alloy) used to form the ground electrode body 33.

The samples had the same dimensions, as follows:

Gap length G: 0.75 mm

Length H1 from leading end of metal shell 50 to leading end of insulator 10: 2 mm Length H2 from leading end of metal shell 50 to leading end of center electrode 20: 3 mm Diameter of leading end of center electrode 20 (diameter of center electrode tip 28): 0.6 mm Cross-sectional size of ground electrode body 33 before bending: 1.3 mm×2.7 mm Length of ground electrode body 33 in longitudinal direction before bending: 10 mm As shown in Table 1 below, different materials were used to form the ground electrode bodies 33 of the samples. The ground electrode bodies of the samples were manufactured by the method described above.

TABLE 1

| | Composition (% by mass) | | | | | | | Si × rare | Void area | Evaluation results | |
|---|---|---|---|---|---|---|---|---|---|---|---|
| No. | Si | Cr | Al | Fe | C | Rare earth | Others | earth | percentage (%) | Pre-ignition resistance | Oxidation resistance |
| 1 | 0.0 | 26 | 0.5 | 15 | 0.10 | 0.01 | 0.2 | 0.00 | 0.1 | A | B |
| 2 | 0.1 | 19 | 0.5 | 15 | 0.10 | 0.01 | 0.2 | 0.00 | 0.2 | A | B |
| 3 | 0.1 | 26 | 0.5 | 15 | 0.10 | 0.00 | 0.4 | 0.00 | 0.1 | A | B |
| 4 | 0.0 | 19 | 0.5 | 15 | 0.10 | 0.01 | 0.2 | 0.00 | 0.2 | A | C |
| 5 | 0.0 | 26 | 0.5 | 15 | 0.10 | 0.00 | 0.4 | 0.00 | 0.1 | A | C |
| 6 | 0.0 | 19 | 0.5 | 15 | 0.10 | 0.00 | 0.2 | 0.00 | 0.2 | A | D |
| 7 | 1.5 | 1 | 0.3 | 1 | 0.05 | 0.50 | 0.2 | 0.75 | 0.2 | A | E |
| 8 | 1.5 | 1 | 0.3 | 1 | 0.05 | 2.00 | 0.1 | 3.00 | 1.1 | A | E |
| 9 | 1.1 | 27 | 1.6 | 20 | 0.11 | 0.13 | 0.2 | 0.14 | 1.1 | F | A |
| 10 | 1.1 | 31 | 1.6 | 20 | 0.11 | 0.13 | 0.2 | 0.14 | 1.3 | F | A |
| 11 | 1.1 | 27 | 1.6 | 10 | 0.11 | 0.13 | 0.1 | 0.14 | 1.2 | F | A |
| 12 | 1.1 | 31 | 1.6 | 10 | 0.11 | 0.13 | 0.3 | 0.14 | 1.2 | F | A |
| 13 | 1.1 | 27 | 0.1 | 20 | 0.11 | 0.13 | 0.1 | 0.14 | 1.2 | F | A |
| 14 | 1.1 | 31 | 0.1 | 20 | 0.11 | 0.13 | 0.2 | 0.14 | 1.1 | F | A |
| 15 | 1.1 | 27 | 0.1 | 10 | 0.11 | 0.13 | 0.3 | 0.14 | 1.2 | F | A |
| 16 | 1.1 | 31 | 0.1 | 10 | 0.11 | 0.13 | 0.1 | 0.14 | 1.1 | F | A |
| 17 | 1.0 | 20 | 0.5 | 13 | 0.10 | 0.15 | 0.1 | 0.15 | 1.2 | F | A |
| 18 | 0.8 | 20 | 0.5 | 13 | 0.10 | 0.15 | 0.2 | 0.12 | 1.1 | F | A |
| 19 | 0.6 | 26 | 1.0 | 17 | 0.10 | 0.20 | 0.1 | 0.12 | 1.1 | F | A |
| 20 | 1.1 | 31 | 0.1 | 10 | 0.11 | 0.21 | 0.2 | 0.23 | 1.0 | E | A |
| 21 | 1.1 | 31 | 1.6 | 10 | 0.11 | 0.21 | 0.1 | 0.23 | 0.9 | E | A |
| 22 | 1.1 | 31 | 0.1 | 20 | 0.11 | 0.21 | 0.3 | 0.23 | 1.0 | E | A |
| 23 | 1.1 | 31 | 1.6 | 20 | 0.11 | 0.21 | 0.2 | 0.23 | 0.9 | E | A |
| 24 | 1.0 | 31 | 1.6 | 11 | 0.11 | 0.10 | 0.3 | 0.10 | 0.6 | E | A |
| 25 | 1.0 | 31 | 1.6 | 19 | 0.11 | 0.10 | 0.2 | 0.10 | 0.7 | E | A |
| 26 | 1.0 | 30 | 1.6 | 10 | 0.11 | 0.15 | 0.1 | 0.15 | 1.0 | E | A |
| 27 | 1.0 | 30 | 1.6 | 20 | 0.11 | 0.15 | 0.2 | 0.15 | 0.9 | E | A |
| 28 | 1.1 | 30 | 1.6 | 11 | 0.11 | 0.10 | 0.1 | 0.11 | 0.7 | E | A |
| 29 | 1.1 | 30 | 1.6 | 19 | 0.11 | 0.10 | 0.1 | 0.11 | 0.7 | E | A |
| 30 | 0.5 | 30 | 1.6 | 11 | 0.11 | 0.21 | 0.2 | 0.11 | 0.6 | E | A |

TABLE 2

| No. | Composition (% by mass) Si | Cr | Al | Fe | C | Rare earth | Others | Si × rare earth | Void area percentage (%) | Evaluation results Pre-ignition resistance | Oxidation resistance |
|---|---|---|---|---|---|---|---|---|---|---|---|
| 31 | 0.5 | 30 | 1.6 | 19 | 0.11 | 0.21 | 0.1 | 0.11 | 0.7 | E | A |
| 32 | 0.8 | 30 | 1.6 | 11 | 0.11 | 0.20 | 0.1 | 0.16 | 0.9 | E | A |
| 33 | 0.8 | 30 | 1.6 | 19 | 0.11 | 0.20 | 0.1 | 0.16 | 1.0 | E | A |
| 34 | 1.0 | 27 | 1.6 | 11 | 0.11 | 0.15 | 0.3 | 0.15 | 0.9 | D | A |
| 35 | 1.0 | 30 | 1.6 | 19 | 0.11 | 0.15 | 0.2 | 0.15 | 0.9 | D | A |
| 36 | 1.0 | 27 | 0.1 | 11 | 0.11 | 0.15 | 0.3 | 0.15 | 0.8 | D | A |
| 37 | 1.0 | 30 | 0.1 | 19 | 0.11 | 0.15 | 0.2 | 0.15 | 0.9 | D | A |
| 38 | 1.0 | 27 | 0.2 | 11 | 0.11 | 0.15 | 0.2 | 0.15 | 0.9 | D | A |
| 39 | 1.0 | 27 | 1.5 | 19 | 0.11 | 0.15 | 0.2 | 0.15 | 0.8 | D | A |
| 40 | 1.0 | 27 | 0.1 | 11 | 0.10 | 0.15 | 0.1 | 0.15 | 0.9 | D | A |
| 41 | 1.0 | 27 | 1.6 | 19 | 0.10 | 0.15 | 0.2 | 0.15 | 1.0 | D | A |
| 42 | 1.0 | 30 | 1.5 | 19 | 0.10 | 0.15 | 0.2 | 0.15 | 0.9 | C | A |
| 43 | 1.0 | 27 | 0.2 | 11 | 0.10 | 0.05 | 0.1 | 0.05 | 0.6 | C | A |
| 44 | 1.0 | 27 | 0.5 | 13 | 0.10 | 0.05 | 0.2 | 0.05 | 0.7 | C | A |
| 45 | 1.0 | 27 | 0.5 | 17 | 0.10 | 0.05 | 0.2 | 0.05 | 0.7 | C | A |
| 46 | 1.0 | 20 | 0.4 | 13 | 0.10 | 0.05 | 0.3 | 0.05 | 0.6 | C | A |
| 47 | 1.0 | 26 | 1.1 | 17 | 0.10 | 0.05 | 0.2 | 0.05 | 0.6 | C | A |
| 48 | 1.0 | 20 | 0.5 | 12 | 0.10 | 0.05 | 0.2 | 0.05 | 0.7 | C | A |
| 49 | 1.0 | 26 | 0.5 | 18 | 0.10 | 0.05 | 0.2 | 0.05 | 0.7 | C | A |
| 50 | 0.5 | 20 | 0.5 | 13 | 0.10 | 0.05 | 0.2 | 0.03 | 0.6 | B | A |
| 51 | 0.5 | 26 | 1.0 | 17 | 0.10 | 0.05 | 0.3 | 0.03 | 0.6 | B | A |
| 52 | 1.0 | 26 | 1.0 | 17 | 0.10 | 0.15 | 0.2 | 0.15 | 0.5 | A | A |
| 53 | 0.1 | 20 | 0.5 | 13 | 0.10 | 0.01 | 0.1 | 0.00 | 0.2 | A | A |

For each type of sample, a plurality of samples were prepared and used for the measurement of the contents of the components, the measurement of void area percentage, the pre-ignition resistance evaluation test, and the oxidation resistance evaluation test.

The alloy used for the ground electrode body 33 of each type of sample contained the additive elements shown in Tables 1 and 2 (Si, Cr, Al, Fe, C, rare earth elements, and other elements) in the amounts (in % by mass) shown in Tables 1 and 2, with the balance Ni. The other elements include incidental impurities. Specifically, the contents of the components in the ground electrode body 33 of each sample were measured by radio-frequency inductively-coupled-plasma (ICP) emission spectroscopy.

The rare earth element present in Samples 1 to 20 was Y. The rare earth element present in Samples 21 to 40 was La. The rare earth element present in Samples 41 to 53 was Ce. Although the samples used herein do not cover all rare earth elements and combinations thereof, samples containing other rare earth elements will yield results similar to those for the samples used herein since it is known that, despite being different elements, rare earth elements have very similar properties.

The void area percentage of the ground electrode body 33 of each type of sample is shown in Tables 1 and 2. The void area percentage was determined as follows. A compositional image of the ground electrode body 33 was captured in a cross-section taken in a plane parallel to the longitudinal direction of the ground electrode body 33, specifically, a cross-section taken in a plane passing through the axial line of the ground electrode body 33 (i.e., the cross-section shown in FIG. 2). Specifically, a compositional image was captured under a JEOL JSM-IT300 scanning electron microscope at an acceleration voltage of 20 kV and a magnification of 150 times in a region at least 0.1 mm apart from the surface of the material. The void area percentage was calculated as the area percentage of voids in the total area of the image (in the example shown in FIG. 4, the area percentage of the black regions in the image).

In the pre-ignition resistance evaluation test, three samples were used for each type of sample to operate an actual engine for 1 hour, 100 hours, and 200 hours. The operation was carried out by attaching a sample to a naturally aspirated four-cylinder gasoline engine with a displacement of 1.3 L and repeating a cycle in which the gasoline engine was operated at full throttle (wide-open throttle (WOT)) for 1 minute and was then allowed to idle for 1 minute. The rotational speed during the operation at full throttle was 3,500 rpm. The rotational speed during the idling was 760 rpm.

After the operation, the sample was evaluated for pre-ignition resistance. Specifically, the gasoline engine was first operated at full throttle and a rotational speed of 3,500 rpm with a spark advance of 30° (ignition timing at 30° before top dead center) for 1 minute.

When abnormal combustion due to pre-ignition occurred less than 40 times during the operation for 1 minute, the spark advance was increased by 2°, and the engine was operated for additional 1 minute. This cycle was repeated to determine the spark advance at which abnormal combustion occurred 40 times or more. Of the spark advances determined after the operation for 1 hour, 100 hours, and 200 hours, the minimum spark advance was determined for evaluation.

Samples with minimum spark advances of 62° or more were rated "A". Samples with minimum spark advances of 56° to 60° were rated "B". Samples with minimum spark advances of 50° to 54° were rated "C". Samples with minimum spark advances of 44° to 48° were rated "D". Samples with minimum spark advances of 38° to 42° were rated "E". Samples with minimum spark advances of 36° or less were rated "F".

In the oxidation resistance evaluation test, each sample was used to operate an actual engine for 200 hours. The operation was carried out by repeating the above cycle in which the gasoline engine was operated at full throttle for 1 minute and was then allowed to idle for 1 minute.

After the operation, a cross-section of the ground electrode body 33 of the sample taken in a plane passing through the axial line (i.e., the cross-section shown in FIG. 2) was examined under a light microscope to measure the thickness of the oxide scale on the surface MA facing away from the gap (see FIG. 2).

Samples having oxide scales with thicknesses of less than 0.1 mm were rated "A". Samples having oxide scales with thicknesses of 0.1 to less than 0.2 mm were rated "B". Samples having oxide scales with thicknesses of 0.2 to less than 0.3 mm were rated "C". Samples having oxide scales with thicknesses of 0.3 to less than 0.4 mm were rated "D". Samples having oxide scales with thicknesses of 0.4 mm or more were rated "E".

The evaluation results are shown in Tables 1 and 2. Samples 1 to 19, which are comparative samples, did not satisfy at least one of conditions (1) to (4) above, which the foregoing embodiment satisfies. Samples 20 to 53, which are samples of the spark plug 100 according to the foregoing embodiment, satisfied at least all of conditions (1) to (4) above.

Conditions (1) to (3), as described above, are conditions for ensuring sufficient oxidation resistance. Samples 1 to 8 did not satisfy at least one of conditions (1) to (3) above. For example, Samples 1 and 4 to 6 contained no Si and thus did not satisfy condition (2) above. Samples 2, 4, and 6 contained 19% by mass of Cr and thus did not satisfy condition (1) above. Samples 7 and 8 contained 1% by mass of Cr and thus did not satisfy condition (1) above. Samples 3, 5, and 6 contained no rare earth element and thus did not satisfy condition (3) above.

The samples that did not satisfy at least one of conditions (1) to (3) above had an oxidation resistance rating of "B" or lower. For example, Samples 7 and 8, which contained extremely small amounts of Cr, had an oxidation resistance rating of "E". This is probably because a chromium oxide film, which serves as a basis for ensuring sufficient oxidation resistance, did not substantially form. Of Samples 1 to 6, which contained certain amounts of Cr, Samples 1 to 3, which satisfied two of conditions (1) to (3) above and did not satisfy the other one, had an oxidation resistance rating of "B". Samples 4 and 5, which satisfied one of conditions (1) to (3) above and did not satisfy the other two, had an oxidation resistance rating of "C". Sample 6, which did not satisfy any of conditions (1) to (3) above, had an oxidation resistance rating of "D".

In contrast, Samples 9 to 53, which satisfied all of conditions (1) to (3) above, had an oxidation resistance rating of "A".

The above results demonstrate that satisfying all of conditions (1) to (3) above ensures sufficient oxidation resistance of the ground electrode body 33.

Conditions (4) to (14) above are conditions for improving pre-ignition resistance. The results of the pre-ignition resistance evaluation for Samples 1 to 8, which had insufficient oxidation resistance, will be described first. Samples 7 and 8 had a pre-ignition resistance rating of "A". In particular, Sample 8 had a pre-ignition resistance rating of "A" even though it had a void area percentage of more than 1% (1.1%). Samples 7 and 8 contained extremely small amounts of Cr (1% by mass) and, accordingly, contained large amounts of Ni (90% by mass or more) and small total amounts of additives. Thus, although Samples 7 and 8 had insufficient oxidation resistance, they probably had sufficient pre-ignition resistance, irrespective of their void area percentages, because the material itself had high thermal conductivity.

Samples 1 to 6 had a pre-ignition resistance rating of "A". This is probably because Samples 1 to 6 satisfied all of conditions (4) to (14) above. Thus, Samples 1 to 6 probably had sufficient pre-ignition resistance.

The results of the pre-ignition resistance evaluation for Samples 9 to 53, which satisfied all of conditions (1) to (3) and thus had sufficient oxidation resistance, will then be described. The samples that had void area percentages of more than 1%, i.e., Samples 9 to 19, which did not satisfy condition (4) above, had a pre-ignition resistance rating of "F", irrespective of the other conditions. For example, Samples 17 to 19 had a pre-ignition resistance rating of "F" even though the contents of Si, Cr, Al., Fe, C, and the rare earth element satisfied conditions (5) to (14) above.

In contrast, Samples 20 to 53, which satisfied condition (4) above, had a pre-ignition resistance rating of "E" or higher, irrespective of the other conditions.

The above results demonstrate that satisfying all of conditions (1) to (3) above ensures sufficient oxidation resistance and that further satisfying condition (4) above reduces the likelihood of pre-ignition.

The results of the pre-ignition resistance evaluation for Samples 20 to 53, which satisfied all of conditions (1) to (4), will then be described in greater detail.

Samples 20 to 33 had a pre-ignition resistance rating of "E". Samples 34 to 53 had a pre-ignition resistance rating of "D" or higher.

Samples 20 to 33, which had a pre-ignition resistance rating of "E", did not satisfy at least one of conditions (5) to (9) above. For example, Samples 20 to 23 did not satisfy any of conditions (5) to (9) above. Although Samples 24 and 25 satisfied conditions (5) and (7) to (9) above, the content of Cr did not satisfy condition (6) above. Although Samples 26 and 27 satisfied conditions (6) to (9) above, the content of Fe did not satisfy condition (5) above. Although Samples 28 and 29 satisfied conditions (5), (6), (8), and (9) above, the content of Si did not satisfy condition (7) above. Although Samples 30 and 31 satisfied conditions (5) to (7) and (9) above, the content of the rare earth element did not satisfy condition (8) above. Although Samples 32 and 33 satisfied conditions (5) to (8) above, the product of the content of Si and the content of the rare earth element did not satisfy condition (9) above.

In contrast, Samples 34 to 53, which had a pre-ignition resistance rating of "D" or higher, satisfied all of conditions (5) to (9) above.

The above results demonstrate that satisfying all of conditions (5) to (9) above in addition to conditions (1) to (4) above reduces the likelihood of pre-ignition more effectively.

The results of the pre-ignition resistance evaluation for Samples 34 to 53, which satisfied all of conditions (1) to (9), will then be described in greater detail.

Samples 34 to 41 had a pre-ignition resistance rating of "D". Samples 42 to 53 had a pre-ignition resistance rating of "C" or higher.

Samples 34 to 41, which had a pre-ignition resistance rating of "D", did not satisfy at least one of conditions (10) and (11) above. For example, Samples 34 to 37 did not satisfy any of conditions (10) and (11) above. Although Samples 38 and 39 satisfied condition (11) above, the content of C did not satisfy condition (10) above. Although Samples 40 and 41 satisfied condition (10) above, the content of Al did not satisfy condition (11) above.

In contrast, Samples 42 to 53, which had a pre-ignition resistance rating of "C" or higher, satisfied all of conditions (10) and (11) above.

The above results demonstrate that satisfying all of conditions (10) and (11) above in addition to conditions (1) to (9) above reduces the likelihood of pre-ignition more effectively.

The results of the pre-ignition resistance evaluation for Samples 42 to 53, which satisfied all of conditions (1) to (11), will then be described in greater detail.

Samples 42 to 49 had a pre-ignition resistance rating of "C". Samples 50 to 53 had a pre-ignition resistance rating of "B" or higher.

Samples 42 to 49, which had a pre-ignition resistance rating of "C", did not satisfy at least one of conditions (12) to (14) above. For example, Samples 42 and 43 did not satisfy any of conditions (12) to (14) above. Although Samples 44 and 45 satisfied conditions (12) and (14) above, the content of Cr did not satisfy condition (13) above. Although Samples 46 and 47 satisfied conditions (13) and (14) above, the content of Al did not satisfy condition (12) above. Although Samples 48 and 49 satisfied conditions (12) and (13) above, the content of Fe did not satisfy condition (14) above.

In contrast, Samples 50 to 53, which had a pre-ignition resistance rating of "B" or higher, satisfied all of conditions (12) to (14) above.

The above results demonstrate that satisfying all of conditions (12) to (14) above in addition to conditions (1) to (11) above reduces the likelihood of pre-ignition more effectively.

Of Samples 50 to 53, which had a pre-ignition resistance rating of "B" or higher, the samples that had void area percentages of more than 0.5%, i.e., Samples 50 and 51, which did not satisfy condition (15) above, had a pre-ignition resistance rating of "B". In contrast, the samples that had void area percentages of 0.5% or less, i.e., Samples 52 and 53, which satisfied condition (15) above, had a pre-ignition resistance rating of "A".

The above results demonstrate that satisfying condition (15) above in addition to conditions (1) to (14) above reduces the likelihood of pre-ignition most effectively.

C. Modifications

C-1. First Modification

In the foregoing embodiment, a Ni alloy that satisfies, of conditions (1) to (15) above, at least conditions (1) to (4) is applied to the ground electrode body 33 of the ground electrode 30. Alternatively, the Ni alloy may be applied to the center electrode body 26 of the center electrode 20. In this case, the heat conduction performance of the center electrode body 26 can be improved while sufficient oxidation resistance of the center electrode body 26 is ensured. The likelihood of pre-ignition can thus be reduced while sufficient oxidation resistance of the center electrode body 26 is ensured.

C-2. Second Modification

Although the ground electrode 30 in the foregoing embodiment includes the ground electrode tip 38, the ground electrode tip 38 may be omitted. In this case, the ground electrode body 33 constitutes the entire ground electrode 30; therefore, the entire ground electrode 30 is formed of a Ni alloy that satisfies, of conditions (1) to (15) above, at least conditions (1) to (4).

Although the ground electrode body 33 of the ground electrode 30 in the foregoing embodiment does not include a core formed of a metal, such as copper, that has a higher thermal conductivity than a Ni alloy, the ground electrode body 33 may include such a core. In this case, the portion other than the core of the ground electrode body 33 of the ground electrode 30 is formed of a Ni alloy that satisfies, of conditions (1) to (15) above, at least conditions (1) to (4).

Thus, generally, the portion of the ground electrode 30 that is formed of the Ni alloy satisfies, of conditions (1) to (15) above, at least conditions (1) to (4). This is also true when the present invention is applied to the center electrode 20.

C-3. Third Modification

The specific configuration of the spark plug 100 according to the foregoing embodiment is for illustration purposes only; other configurations may also be employed. For example, the firing end of a spark plug may have various configurations. For example, the spark plug may be of a type in which the ground electrode 30 and the center electrode 20 are disposed opposite each other in a direction perpendicular to the axial line to form a gap therebetween. Alternatively, the spark plug may be of a type that includes a plurality of ground electrodes 30 and a single center electrode 20 that form a plurality of gaps therebetween.

For example, the insulator 10 and the terminal nut 40 need not be formed of the materials as described above. For example, instead of a ceramic containing alumina ($Al_2O_3$) as a major component, the insulator 10 may be formed of a ceramic containing another compound (e.g., AlN, $ZrO_2$, SiC, $TiO_2$, or $Y_2O_3$) as a major component.

Although an embodiment of the present invention and modifications thereof have been described above, they are not intended to limit the invention in any way; rather, various embodiments and modifications are possible without departing from the spirit thereof.

Having described the invention, the following is claimed:

1. A spark plug comprising a center electrode and a ground electrode that form a gap therebetween, wherein at least one of the center electrode and the ground electrode comprises a portion comprising a nickel alloy containing nickel as a major component and 20% by mass or more of chromium, and in the portion, comprising the nickel alloy, of the electrode, the content of silicon is 0.1% by mass or more, the total content of one or more particular elements selected from the group consisting of rare earth elements is 0.01% by mass or more, and the area percentage of voids in the total area of a cross-section parallel to a longitudinal direction is 1% or less.

2. The spark plug according to claim 1, wherein, in the portion, comprising the nickel alloy, of the electrode, the content of iron is 11% to 19% by mass, the content of chromium is 30% by mass or less, the content of silicon is 1% by mass or less, the total content of the one or more particular elements is 0.2% by mass or less, and the product of the content of silicon and the content of the one or more particular elements is 0.15 or less.

3. The spark plug according to claim 2, wherein, in the portion, comprising the nickel alloy, of the electrode, the content of carbon is 0.1% by mass or less, and the content of aluminum is 0.2% to 1.5% by mass.

4. The spark plug according to claim 3, wherein, in the portion, comprising the nickel alloy, of the electrode, the content of aluminum is 0.5% to 1.0% by mass, the content of chromium is 26% by mass or less, and the content of iron is 13% to 17% by mass.

5. The spark plug according to claim 4, wherein, in the portion, comprising the nickel alloy, of the electrode, the area percentage of voids in the total area of the cross-section parallel to the longitudinal direction is 0.5% or less.

* * * * *